US007601109B2

(12) United States Patent
Roumayah

(10) Patent No.: US 7,601,109 B2
(45) Date of Patent: Oct. 13, 2009

(54) ABDOMINAL EXERCISE DEVICE

(76) Inventor: Gary Roumayah, 28716 Grandon St., Livonia, MI (US) 48150

( * ) Notice: Subject to any disclaimer, the term of this patent is extended or adjusted under 35 U.S.C. 154(b) by 52 days.

(21) Appl. No.: 11/636,869

(22) Filed: Dec. 11, 2006

(65) Prior Publication Data

US 2007/0173390 A1 Jul. 26, 2007

Related U.S. Application Data

(60) Provisional application No. 60/749,274, filed on Dec. 9, 2005.

(51) Int. Cl.
*A63B 26/00* (2006.01)

(52) U.S. Cl. ..... 482/142; 482/140

(58) Field of Classification Search ..... 482/142, 482/95–100, 122–123, 140, 907
See application file for complete search history.

(56) References Cited

U.S. PATENT DOCUMENTS 3,117,782 A * 1/1964 Johnston ..... 482/95
5,366,426 A * 11/1994 Glavin ..... 482/56
5,857,949 A * 1/1999 Tebbe et al. ..... 482/140
6,113,564 A * 9/2000 McGuire ..... 602/32
6,592,502 B1 * 7/2003 Phillips ..... 482/143
6,685,605 B1 * 2/2004 Klossner ..... 482/142
7,179,206 B2 * 2/2007 Backes et al. ..... 482/80
7,276,833 B2 * 10/2007 Ernest et al. ..... 310/263
2007/0015644 A1 * 1/2007 Aucamp ..... 482/130
2007/0129226 A1 * 6/2007 Leavitt ..... 482/129

* cited by examiner

*Primary Examiner*—Lori Amerson
(74) *Attorney, Agent, or Firm*—Brinks Hofer Gilson & Lione

(57) ABSTRACT

An abdominal exercise device incorporating a generally horizontal bench surface. A cable system includes a hand grip handle at one end and an abdominal strap connected with the other. A pulley system causes the cable to be routed from one end of the exercise bench underneath the bench to the opposite end. The user fastens the abdominal strap around their upper torso and grasps the hand grip handle. Tension applied to the cable by the handgrip handle causes a resistance force acting on the upper torso of the user which provides a desired resistance for abdominal muscle conditioning.

3 Claims, 3 Drawing Sheets

ABDOMINAL EXERCISE DEVICE

CROSS REFERENCE TO RELATED APPLICATION

This application claims priority to U.S. Ser. No. 60/749,274, filed Dec. 9, 2005.

FIELD OF THE INVENTION

This invention relates to an exercise and therapeutic training device especially adapted for developing and exercising abdominal muscles.

BACKGROUND OF THE INVENTION

Numerous devices and training techniques are known to exercise abdominal muscles. Abdominal muscle conditioning is a key element in overall physical conditioning and especially for sports activities, general fitness and creating a desired trim body shape. Many devices incorporating elastic bands, weights and articulating exercise machines are known. Although generally successful, improvements in such devices are desirable, especially in terms of creating the desired training outcomes, with low cost and light weight equipment.

SUMMARY OF THE INVENTION

In accordance with this invention, a novel exercise device is provided in which pulleys and a cable or rope is used in which a user exerts a restraining force against their own movement between a sitting and lying back position which provides forces which are resisted by abdominal muscles.

The device in accordance with this invention is very simple in construction and does not require weights or elastic devices. Moreover, the user can increase the training effect merely by exerting more of their own force on the cable device. The device is believed to provide superior training effects for the user.

These and other aspects and advantages of the present invention will become apparent upon reading the following detailed description of the invention in combination with the accompanying drawings.

DETAILED DESCRIPTION OF THE INVENTION

Figure 1:
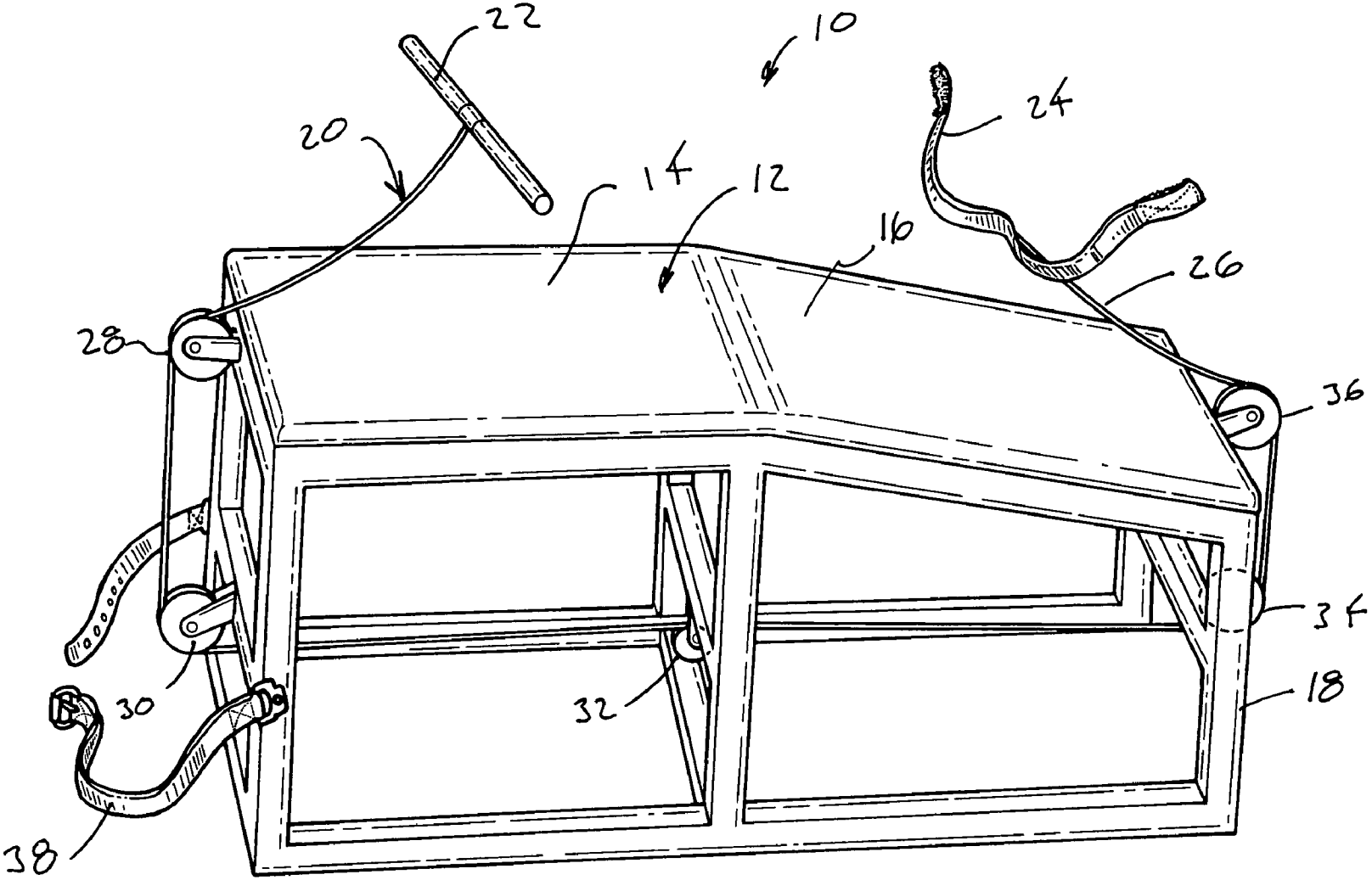
FIG. 1 is a pictorial view of an abdominal exercise device in accordance with the present invention.

FIG. 1 illustrates abdominal exercise device 10 which incorporates a padded generally horizontal bench surface 12 divided into two sections, a first horizontal section 14 and a downwardly inclined section 16 for the users back. Exercise device 10 further incorporates a lower framework 18 which supports bench surface 12 elevated above the surface of the floor for convenient use of the device. Exercise device 10 supports a user with their back on inclined section 16, their upper legs resting on bench surface 14, and their lower legs hanging from an end of bench surface 14. Section 16 could be made to be adjustable or flat to accommodate the desired exercise motion of a user. A cable system 20 is provided which includes hand grasping handle 22 and upper torso strap 24 which are connected together at opposite ends of cable 26. Cable 26 runs over a number of pulleys illustrated in FIG. 1 including pulleys 28, 30, 32, 34 and 36, which are mounted to lower framework 18. These pulleys are arranged such that pulling on hand grip handle 22 creating tension on cable 26 and causes strap 24 to move away from the handle, that is, moves toward the pulley 36 and at the end of exercise device 10. Pulleys 28 and 36 are positioned to guide cable 26 at the ends of bench surface 12. In alternate embodiments, the multiple pulleys 28 through 36 could be replaced by larger or tandem pulleys at both ends of the device (not shown). Furthermore, in the embodiment illustrated in FIG. 1, pulley 32 is optional since it merely serves as a guide for cable 26 as it passes underneath bench 12.

Leg strap 38 attached to lower framework 18 is provided for securing the ankles of the user to restrain the lower torso during exercising movements, as will be described in further detail below.

Figure 2:
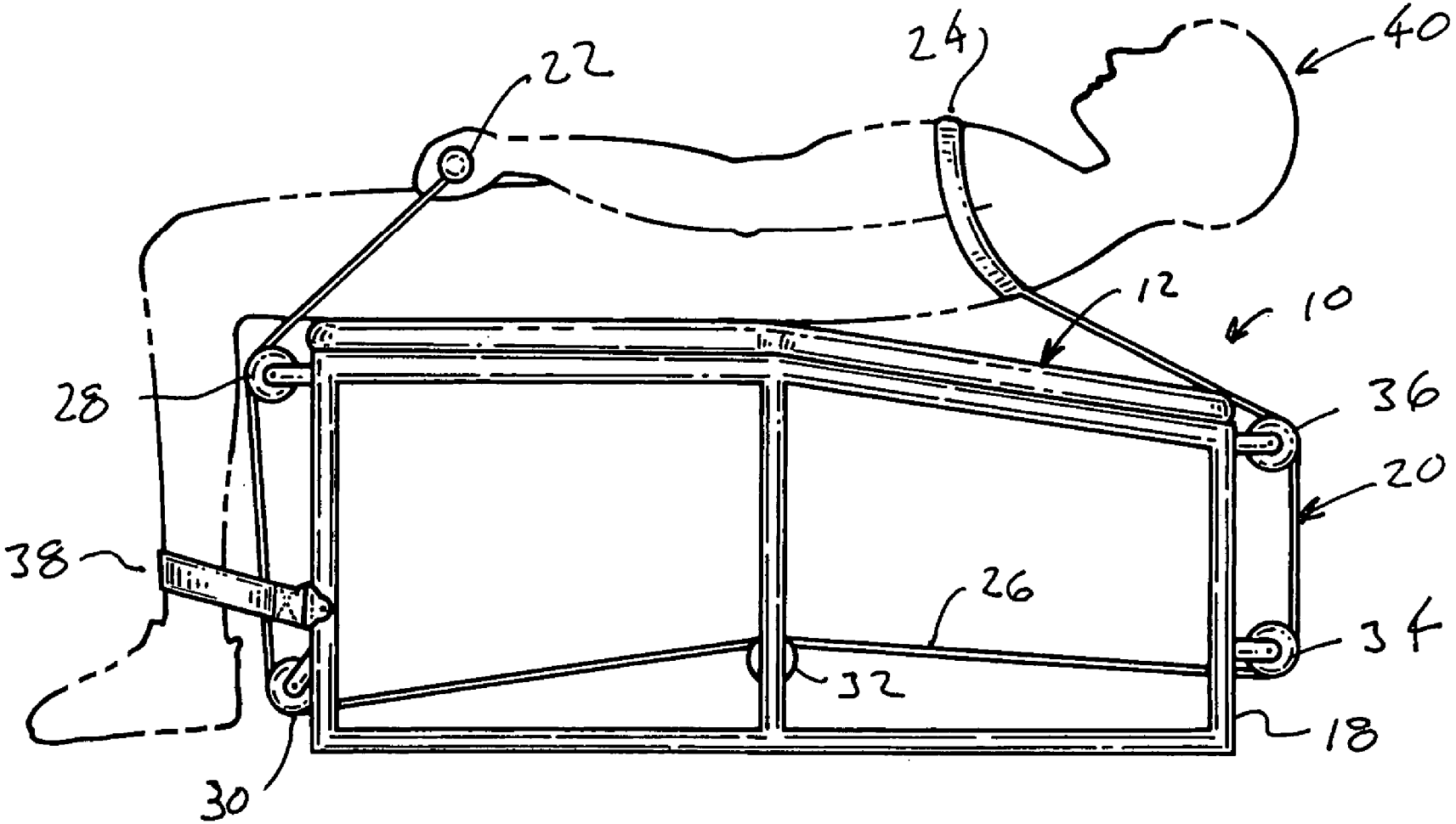
FIG. 2 is a side view of the abdominal exercise device in accordance with this invention showing a representative user in phantom lines in a lying back position.

FIG. 2 illustrates a human user 40 lying on exercise device 10 in preparation for exercising movement. As illustrated, the legs of user 40 are secured by leg strap 38 and upper torso strap 24 is fastened around the upper chest area of the user. Although strap 24 is illustrated as passing outside the arms of the user, it is likely preferable to pass the strap under the armpits of the user when it is fastened. The user 40 is also showing grasping hand grasp handle 22 in preparation for exercising movement.

Figure 3:
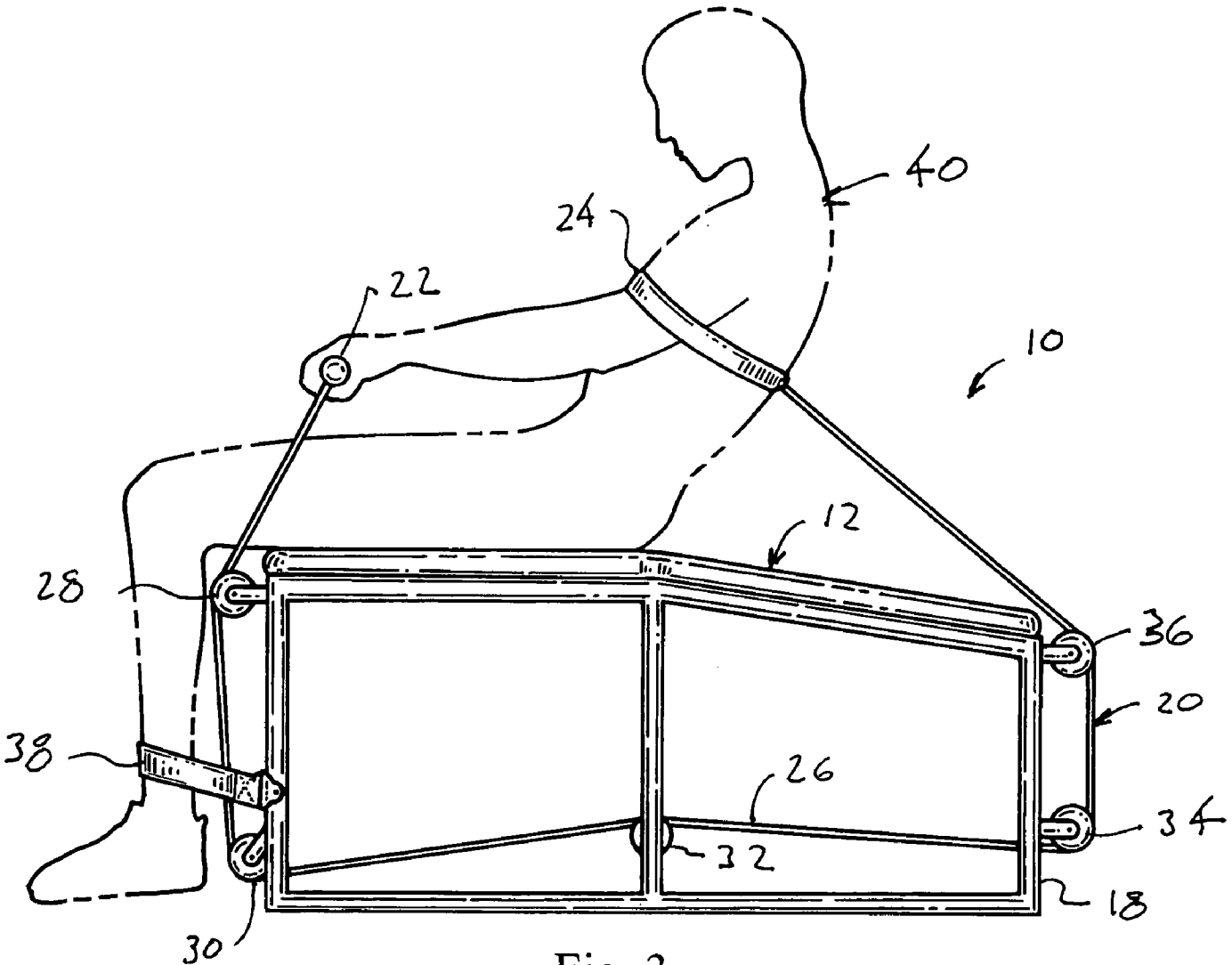
FIG. 3 is a side view of an exercise device in accordance with this invention showing a user in phantom in a seated upright position.

FIG. 3 illustrates user 40 in a seated upright position with the various attachments fastened in the manner described previously.

During exercising movement, the user moves between the lying position shown in FIG. 2 to the seated upright position shown in FIG. 3 in a repetitive exercise motion. Forces exerted on cable 26 by the user's arm create tension in the cable end connecting with strap 24. This tension exerts a force, urging the upper torso down toward the bench surface 12 and therefore this force must be resisted by the actions of the abdominal muscles of the user. During exercising movement, the user can control the resistance force merely by the tension applied to hand grip handle 22 against the restraint generated by the attachment of upper torso strap 24. In experiments with prototypes of the present invention it has been found that this exercising movement using device 10 provides a highly focused training effect on the user's abdominal muscles. The entire abdominal exercise device 10 may be made conveniently portable and light weight since no weights or elastically deformable resistance elements are required. It should be emphasized that the horizontal section takes resistance off the legs and thighs especially unique from conventional slant boards. Focuses resistance to abs.

This machine can be used by two people at once. One person on the machine and another sitting on the floor facing the front of the machine with their feet braced against the front. The second person cold pull on hand grip and put resistance on the user and at the same time get a moderate workout for their own arms and upper body.

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

The invention claimed is:

1. An abdominal exercise device comprising:

a bench having a generally horizontal bench surface, a lower framework supporting the bench surface at an elevated position above a floor surface, wherein a user's lower legs may hang off one end of the bench surface to engage a leg strap affixed to the lower framework, a cable system including a hand grip handle connected to one end of a cable and an abdominal strap connected to the other end of the cable, said cable system positioned underneath said bench in a parallel orientation relative to the longitudinal axis of said bench, a pulley system for allowing the cable to pass from one end of the bench underneath the bench surface to the opposite end of the bench wherein the pulley system includes at least a first and a second pulley affixed to the lower framework adjacent to opposite ends of the bench surface such that the user lying or seated on the bench surface may grasp the handle and exert tension in the cable, the tension in the cable being exerted on the strap positioned around the upper torso of the user whereby the tension exerts forces on the user acting to urge the user toward the lying down position, which tension is resisted by the abdominal muscles of the user.

2. An abdominal exercise device according to claim 1 wherein the tension in the cable is exerted entirely by the user exerted between the hand grip and the abdominal strap.

3. An abdominal exercise device according to claim 1 wherein the generally horizontal bench surface includes a first horizontal section and a downwardly inclined section positioned to support the user's back.

* * * * *